US009957131B2

(12) United States Patent
Agirman et al.

(10) Patent No.: US 9,957,131 B2
(45) Date of Patent: May 1, 2018

(54) ELEVATOR SPEED CONTROL

(71) Applicant: OTIS ELEVATOR COMPANY, Farmington, CT (US)

(72) Inventors: Ismail Agirman, Southington, CT (US); Edward Piedra, Chicopee, MA (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 361 days.

(21) Appl. No.: 14/651,284

(22) PCT Filed: Dec. 13, 2012

(86) PCT No.: PCT/US2012/069425

§ 371 (c)(1),
(2) Date: Jun. 11, 2015

(87) PCT Pub. No.: WO2014/092707

PCT Pub. Date: Jun. 19, 2014

(65) Prior Publication Data

US 2015/0329317 A1 Nov. 19, 2015

(51) Int. Cl.
*B66B 1/30* (2006.01)
*B66B 5/14* (2006.01)

(52) U.S. Cl.
CPC ..... *B66B 1/30* (2013.01); *B66B 1/308* (2013.01); *B66B 5/145* (2013.01)

(58) Field of Classification Search
CPC ..... B66B 1/30; B66B 1/308; B66B 5/145
USPC ..... 187/293
See application file for complete search history.

(56) References Cited

U.S. PATENT DOCUMENTS 3,741,348 A * 6/1973 Caputo ..... B66B 1/30 187/284
4,804,067 A * 2/1989 Kahkipuro ..... H02P 25/10 187/296
7,327,111 B2 * 2/2008 Rastogi ..... H02M 7/493 187/293
7,992,689 B2 8/2011 Stolt et al.
8,230,978 B2 7/2012 Agirman et al.
8,997,939 B2 * 4/2015 Acquaviva ..... B66B 1/24 187/285

(Continued)

FOREIGN PATENT DOCUMENTS

EP 0575140 A1 12/1993
EP 1911712 B1 3/2012

(Continued)

OTHER PUBLICATIONS

European Search Report for application EP 12889747.7, dated Jul. 12, 2016, 7 pages.

(Continued)

*Primary Examiner* — David Warren
(74) *Attorney, Agent, or Firm* — Cantor Colburn LLP

(57) ABSTRACT

Embodiments are directed to calculating a current associated with a motor of an elevator based on an output of a speed regulator, and controlling the elevator based on the current. Embodiments are directed to examining a feeder current obtained via a converter current sensor of a regenerative drive during a peak power condition, and regulating a speed of an elevator based on the feeder current.

10 Claims, 3 Drawing Sheets

(56) References Cited

U.S. PATENT DOCUMENTS

| | | | | |
|---|---|---|---|---|
| 2004/0182652 | A1* | 9/2004 | Ammon | B66B 11/043 187/277 |
| 2005/0077113 | A1* | 4/2005 | Deplazes | B60L 13/10 187/293 |
| 2006/0113148 | A1* | 6/2006 | Delange | B66B 1/30 187/284 |
| 2009/0322273 | A1* | 12/2009 | Kallioniemi | B66B 1/30 318/503 |
| 2010/0300815 | A1* | 12/2010 | Stolt | B66B 1/3476 187/277 |
| 2012/0043164 | A1 | 2/2012 | Acquaviva | |
| 2012/0318613 | A1* | 12/2012 | Stolt | B66B 1/304 187/247 |
| 2013/0015021 | A1* | 1/2013 | Stolt | B66B 1/30 187/305 |
| 2014/0027209 | A1* | 1/2014 | Kallioniemi | B66B 5/0025 187/391 |
| 2015/0329317 | A1* | 11/2015 | Agirman | B66B 1/308 187/293 |

FOREIGN PATENT DOCUMENTS

| | | | |
|---|---|---|---|
| JP | H11299290 | A | 10/1999 |
| JP | 2010168139 | A | 8/2010 |
| JP | 05036147 | B2 | 9/2012 |

OTHER PUBLICATIONS

International Search Report for application PCT/US2012/069425, dated Aug. 30, 2013, 6 pages.
Written Opinion for application PCT/US2012/069425, dated Aug. 30, 2013, 8 pages.

* cited by examiner

ELEVATOR SPEED CONTROL

BACKGROUND

In a given elevator system or environment, the speed of the elevator may need to be controlled. For example, the elevator's speed may be regulated (e.g., limited) based on a capability or capacity of an associated motor drive.

In order to control the speed of an elevator, current sensors have been used in connection with feedback control, wherein a rotation speed of a motor may be monitored so that the rotation speed corresponds to a rated speed. In this manner, relative to a baseline load (e.g., a half-loaded elevator), the elevator may be slowed down for, e.g., a full load, or speeded-up for, e.g., an empty elevator car.

BRIEF SUMMARY

An embodiment of the disclosure is directed to a method comprising: calculating a current associated with a motor of an elevator based on an output of a speed regulator, and controlling the elevator based on the current.

An embodiment of the disclosure is directed to a method comprising: examining a feeder current obtained via a converter current sensor of a regenerative drive during a peak power condition, and regulating a speed of an elevator based on the feeder current.

An embodiment of the disclosure is directed to a method comprising: measuring, during a constant acceleration of an elevator, two voltages associated with a motor at two different speeds of the elevator, forming a linear equation between motor voltage and elevator speed, the linear equation comprising a slope and an offset, calculating the slope and the offset based on the two voltages and two different speeds, and calculating a base speed for the elevator based on the slope, the offset, and a maximum output of a drive associated with the elevator.

An embodiment of the disclosure is directed to a system comprising: a speed regulator configured to receive a speed feedback and a speed reference and generate a torque current reference, a controller configured to control an elevator's operation based on the torque current reference.

Additional embodiments are described below.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
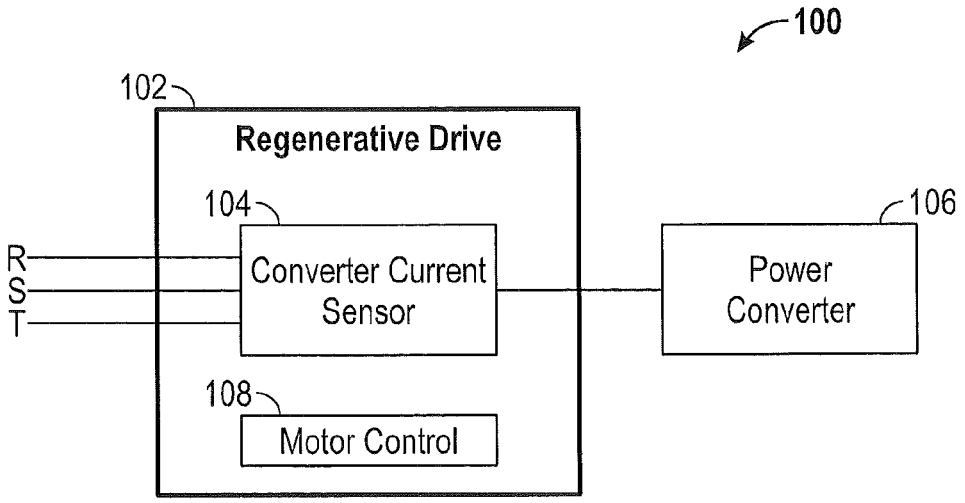
FIG. 1 illustrates an exemplary regenerative drive system in accordance with one or more embodiments of the disclosure.

Exemplary embodiments of apparatuses, systems and methods are described for safely and effectively controlling an elevator. In some embodiments, the speed of an elevator, or a motor associated with the elevator, may be regulated based on a motor current. The motor current may be determined or inferred based on one or more techniques. For example, a current command, a drive input current, and/or a motor voltage may be examined to determine the motor current. In this manner, a current sensor might not be used.

It is noted that various connections are set forth between elements in the following description and in the drawings (the contents of which are included in this disclosure by way of reference). It is noted that these connections in general and, unless specified otherwise, may be direct or indirect and that this specification is not intended to be limiting in this respect. In this respect, a coupling between entities may refer to either a direct or an indirect connection.

FIG. 1 illustrates a regenerative drive system 100 in an exemplary embodiment. The regenerative drive system 100 may be included as a part of an elevator or elevator system. The regenerative drive system 100 may be used to capture energy that would otherwise be expended in operating the elevator, thereby improving the efficiency of the elevator.

The regenerative drive system 100 may include a regenerative drive 102. The regenerative drive 102 may include a converter current sensor 104. The converter current sensor 104 may be used to sense so-called "R", "S", and "T" currents, as those currents are known to those of skill in the art. The sensed currents, which may be associated with one or more power supplies, may be provided to a controller (not shown in FIG. 1) to regulate operation of a power converter 106. The power converter 106 may be configured to control a bus voltage (e.g., a DC bus voltage) and maintain it at a selected level by controlling active power/current flow into the regenerative drive 102 from input lines connected to the "R", "S", and "T" input terminals.

In some embodiments, instead of using a motor current sensor to control (e.g., reduce) speed, a feeder current via the converter current sensor 104 may be used during, e.g., a peak power condition. The feeder current may be compared to a threshold, such as a nominal peak current threshold for a given AC line voltage. In this manner, the speed of the elevator may be controlled via the profile associated with the feeder current without increasing the motor current, which could be a result of overload in an elevator car or excessive field weakening. Output power may be obtained by examining the input to a converter (e.g., converter 106). For example, the input power to the converter may correspond to the power associated with an inverter, since the power might have nowhere else to go.

Figure 2:
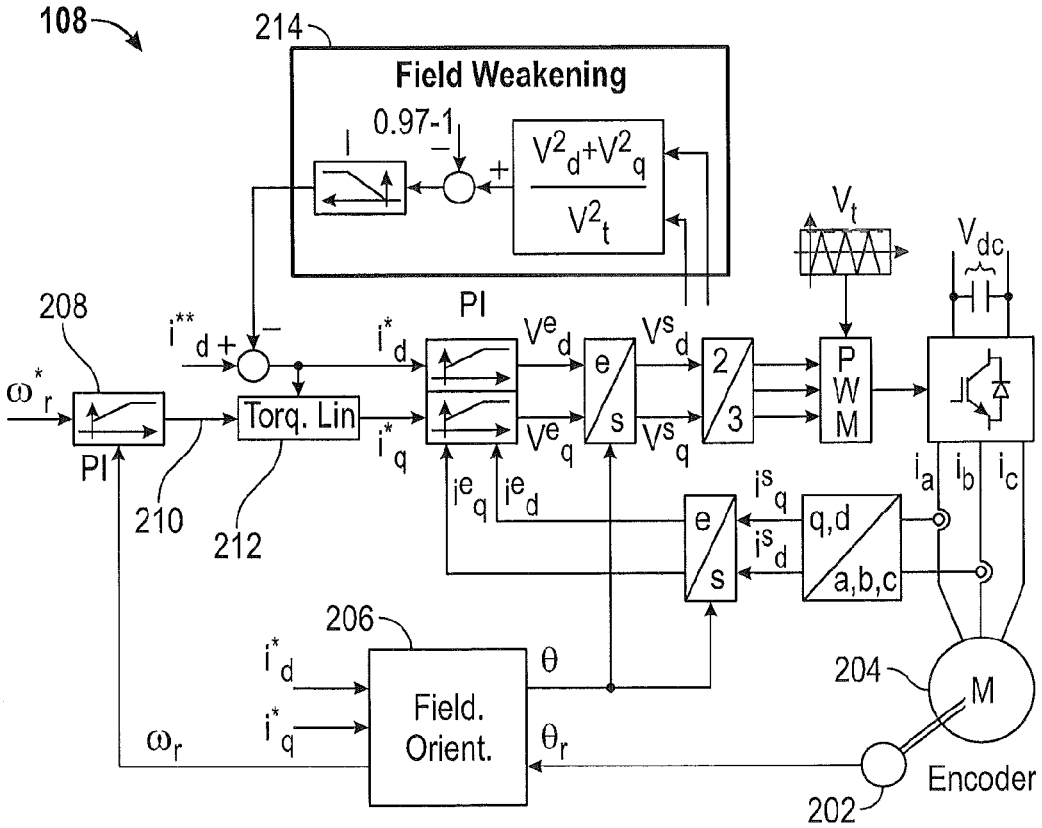
FIG. 2 illustrates an exemplary motor control in accordance with one or more embodiments of the disclosure.

The regenerative drive 102 may include a motor control 108. A more detailed view of the motor control 108 is provided in FIG. 2. The functionality and structure associated with some of the components and devices shown in FIG. 2 are known to those of skill in the art. As such, and for the sake of brevity, a complete description of those components/devices is omitted herein.

The motor control 108 may include an encoder 202. The encoder 202 may be configured to provide a position of a machine or motor 204 as it rotates. The encoder 202 may be configured to provide speed of the motor 204. For example, delta positioning techniques, potentially as a function of time, may be used to obtain the speed of the motor 204.

The motor control 108 may include a field orientation device 206. The field orientation device 206 may be configured to rotate or manipulate AC currents into a frame where the currents appear as if they are DC currents. Such manipulation may be used to enhance control and resolution.

The field orientation device 206 may be configured to generate a speed feedback ($\omega_r$). The speed feedback $\omega_r$ may be provided to a speed controller or PI regulator 208. The PI regulator 208 may receive as an input a speed reference ($\omega_r$*). The PI regulator 208 may compare the speed feedback $\omega_r$ to the speed reference $\omega_r$* and may generate an output signal 210 based on the comparison. The signal 210 may correspond to a torque reference that may be used by a torque controller 212. Based on the torque reference, the torque controller 212 may attempt to operate the motor 204 at a specified torque to obtain a particular speed. In this way, the speed of the motor 204 may be controlled or regulated.

In some embodiments, when a DC bus voltage droops or sags, which may be indicative of an increased load, the motor 204 may run out of or be starved of voltage. A field weakening 214 may be used to inject additional current (which may be included in $i_d$*) to compensate for the sag in the voltage. In this manner, motor current references ($i_q$* and $i_d$*) may be used to calculate total motor current, where a q-axis reference ($i_q$*) may come from the regulator 208 output as described above, and a d-axis reference ($i_d$*) may correspond to a summation of the maximum torque per ampere current ($i_d$) and the motor voltage regulator output current (e.g., the output of the field weakening 214**, which may be referred to as $i_d$ fwref). Thus, the total motor current may be equal to sqrt[($i_d$*)^2+($i_q$*)^2], where sqrt is the square root function applied to the argument. One caveat with this approach is the understanding that part of $i_d$* is $i_d$ fwref, which may be calculated implicitly via current sensors of current regulators.

Figure 3:
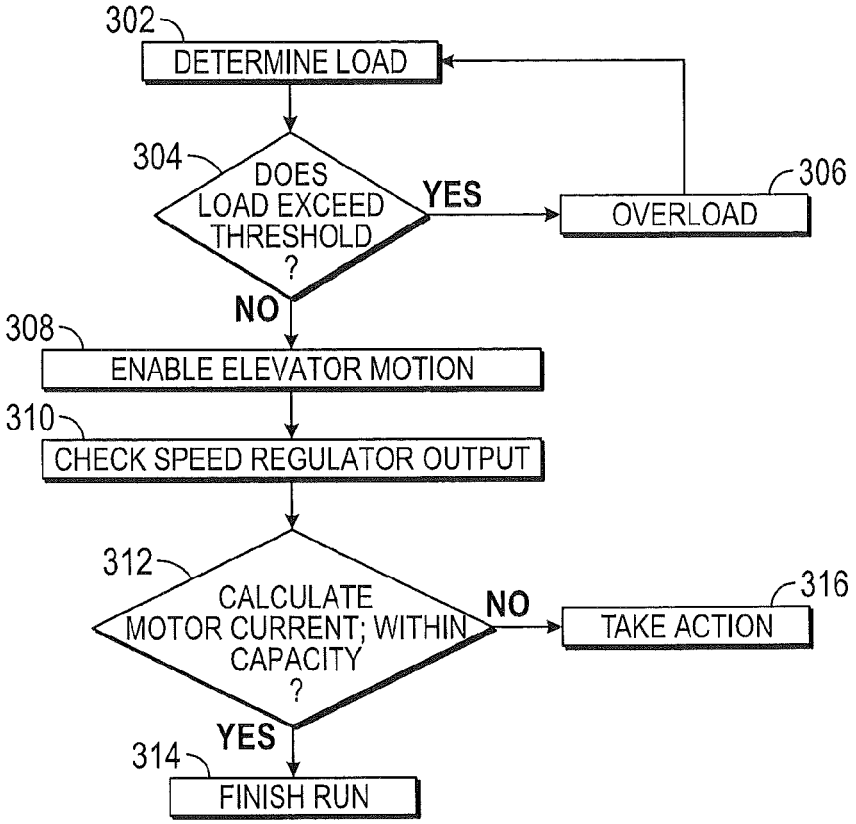
FIG. 3 illustrates an exemplary method of calculating a current in accordance with one or more embodiments of the disclosure.

FIG. 3 illustrates a method that may be used in connection with one or more devices or systems, such as those described herein. The method of FIG. 3 may be used to regulate a speed of an elevator or motor based on a speed regulator (e.g., the regulator 208) output as described further below.

In block 302, a load associated with the elevator may be determined. The load may be expressed in accordance with one or more terms, such as a weight. The weight may be expressed as a fraction or percentage of a rated weight that the motor is capable of supporting.

In block 304, the determined load of block 302 may be compared to a threshold. For example, in block 304 the determined load (e.g., weight) may be compared to 110% of a rated load (e.g., weight). If the determined load exceeds the threshold (e.g., the "Yes" path is taken out of block 304), an overload condition may be declared in block 306. As part of block 306, the elevator may remain at its current location or floor, and flow may proceed back to block 302 to determine the load in order to check for when the excess load has been removed or eliminated. On the other hand, if in block 304 the determined load does not exceed the threshold (e.g., the "No" path is taken out of block 304), flow may proceed to block 308.

In block 308, elevator motion may be enabled. From there, flow may proceed to block 310.

In block 310, an output of the speed regulator may be checked or examined. The speed regulator output may be checked in connection with a number of events. For example, the speed regulator output may be checked right after pre-torque, when holding the elevator car. The speed regulator output may be checked during an acceleration phase to determine a running speed of the elevator. The speed regulator output may be used as a torque current reference (e.g., $i_q$*) for the current regulators where it is indicative of the torque current. From block 310, flow may proceed to block 312.

In block 312, the speed regulator output or torque current reference may be used to infer or calculate the motor current. As part of block 312, the speed regulator output may be compared to one or more thresholds. For example, a first threshold may be used when holding the car and a second threshold, which may be different from the first threshold, may be used during acceleration.

Based on the comparison(s) with the threshold(s) in block 312, a determination may be made whether the motor current is within the capacity or limit of the drive and/or motor. If the motor current is within the capacity/limit (e.g., the "Yes" path is taken out of block 312), flow may proceed to block 314 where the current elevator operation or run may be finished. On the other hand, if the motor current is not within the capacity/limit (e.g., the "No" path is taken out of block 312), flow may proceed to block 316.

In block 316, one or more actions may be taken in response to the motor current exceeding the capacity/limit. For example, the elevator may be forced to stop or halt. In some embodiments, the elevator may be gracefully or slowly brought to a stop and may run back to an initial position. In some embodiments, a speed reference (e.g., $\omega_r$*) may be reduced and the elevator may proceed to an initial landing.

Figure 4:
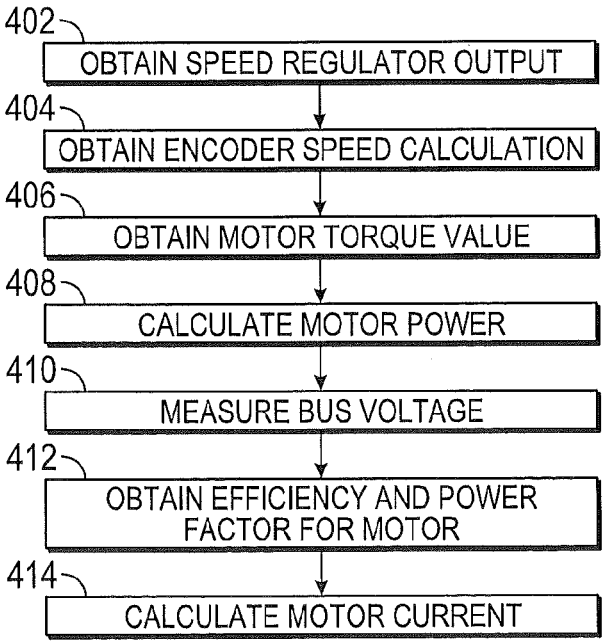
FIG. 4 illustrates an exemplary method of calculating a current in accordance with one or more embodiments of the disclosure.

FIG. 4 illustrates a method that may be used in connection with one or more devices or systems, such as those described herein. The method of FIG. 4 may be used to regulate a speed of an elevator or motor based on a speed regulator (e.g., the regulator 208) output, potentially in combination with an encoder (e.g., encoder 202) output and a bus voltage, as described further below.

In block 402, the speed regulator output may be obtained. The speed regulator output may correspond to $i_q$* and may be obtained in a manner similar to block 310 described above.

In block 404, the encoder speed calculation ($\omega_{encoder}$) may be obtained.

In block 406, a motor torque value (Kt) may be obtained. Kt may be a constant for a given motor.

In block 408, motor power ($P_{motor}$) may be calculated based on blocks 402-406. For example, $P_{motor}$ may be calculated as the product of the blocks 402-406, or:

$$P_{motor}=(i_q^*)\times(\omega_{encoder})\times(Kt)$$

In block 410, a bus voltage ($V_{bus}$) may be measured. $V_{bus}$ may correspond to a drive DC bus voltage, which could be a battery voltage in a battery-based drive.

In block 412, an efficiency parameter (η) and a power factor parameter (PF) for the motor may be obtained. For example, η and PF may be (approximately) constant for a given motor. In some embodiments, η and PF, and potentially Kt, may be stored in a memory or table, potentially in connection with one or more software programs when the motor or elevator is installed.

In block 414, the motor current ($I_{motor}$) may be calculated based on blocks 402-412. For example, $I_{motor}$ may be calculated as:

$$I_{motor}=P_{motor}/(\eta\times PF\times V_{bus}/\mathrm{sqrt}(3))$$

Figure 5:
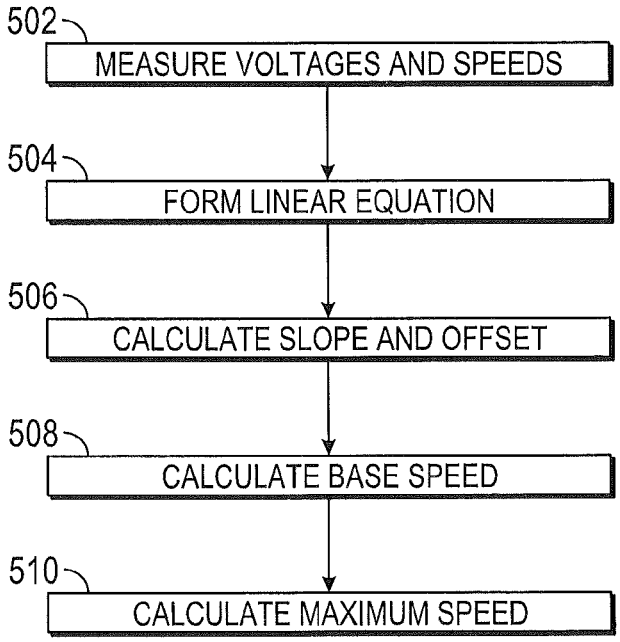
FIG. 5 illustrates an exemplary method of calculating a maximum speed for an elevator run based on a motor voltage in accordance with one or more embodiments of the disclosure.

In some embodiments, motor voltage may be used to determine a speed (e.g., a maximum speed) for an elevator run or operation. FIG. 5 illustrates a method for determining a maximum speed for a run based on a motor voltage. The method of FIG. 5 may be used in connection with one or more devices or systems, such as those described herein.

In block 502, voltage measurements or readings may be conducted. For example, during a constant acceleration two voltage readings ($V_1$ and $V_2$) may be taken at two different speeds ($w_1$ and $w_2$). The voltage readings may be commanded or sensed.

In block 504, a linear equation may be formed between the voltage (V) and the speed (w). For example, the linear equation may take the form:

$$V=(m\times w)+b,$$

where 'm' may be representative of a slope in terms of a change in voltage relative to a change in speed, and 'b' may be representative of a voltage offset or intercept.

Based on the measured voltages and speeds, the slope m and offset b may be calculated in block 506 as follows:

$$m=(V_2-V_1)/(w_2-w_1), \text{ and}$$

$$b=V_2-(m\times w_2)$$

In block 508, a base speed ($w_{base}$) may be calculated as follows:

$$w_{base}=(V_{max}-b)/m,$$

where $V_{max}$ may be given for a given drive application and may be representative of the maximum output of that drive. In some embodiments, $V_{max}$ may be a function of a bus voltage. The base speed ($w_{base}$) may be indicative of the speed at which the elevator begins to "jerk" into constant velocity.

Based on the base speed calculated in block 508, a maximum speed ($w_{max}$) may be calculated in block 510 as follows:

$$w_{max}=w_{base}/\lambda$$

where λ may be representative of a parameter associated with a fraction or percentage of the motor's full speed (e.g., 0.75 or 75%).

The maximum speed ($w_{max}$) may correspond to a maximum constant speed an elevator can achieve for a given load condition provided that the floor to floor distance and acceleration and jerk rates allow this maximum speed to be achieved.

In some embodiments, motor voltage may be maintained at the maximum level at full speed using a motor voltage regulator.

The methods illustrated in connection with FIGS. 3-5 are illustrative. In some embodiments, one or more of the blocks or operations (or portions thereof) may be optional. In some embodiments, the operations may execute in an order or sequence different from what is shown. In some embodiments, additional operations not shown may be included.

Embodiments of the disclosure may maximize elevator performance. For example, such maximization may be determined in accordance with one or more of an acceleration, velocity, or speed. Embodiments of the disclosure may serve to minimize current or power consumption by an elevator.

In some embodiments, an elevator speed governor may regulate the operation of an elevator. For example, the governor may be configured to deal with or handle power and propulsion limitations associated with the elevator or the elevator's motor.

Embodiments of the disclosure may determine a load associated with an elevator and select a speed for the elevator based on the load. In some embodiments, a current (e.g., a total current) associated with the elevator's motor may be computed or inferred without using a current sensor. In some embodiments, operation of an elevator may be based on one or more of a current command (produced by a velocity control unit), a drive input current, and a motor voltage.

As described herein, in some embodiments various functions or acts may take place at a given location and/or in connection with the operation of one or more apparatuses, systems, or devices. For example, in some embodiments, a portion of a given function or act may be performed at a first device or location, and the remainder of the function or act may be performed at one or more additional devices or locations.

Embodiments may be implemented using one or more technologies. In some embodiments, an apparatus or system may include one or more processors, and memory storing instructions that, when executed by the one or more processors, cause the apparatus or system to perform one or more methodological acts as described herein. In some embodiments, one or more input/output (I/O) interfaces may be coupled to one or more processors and may be used to provide a user with an interface to an elevator system. Various mechanical components known to those of skill in the art may be used in some embodiments.

Embodiments may be implemented as one or more apparatuses, systems, and/or methods. In some embodiments, instructions may be stored on one or more computer-readable media, such as a transitory and/or non-transitory computer-readable medium. The instructions, when executed, may cause an entity (e.g., an apparatus or system) to perform one or more methodological acts as described herein.

Embodiments may be tied to one or more particular machines. For example, one or more architectures or controllers may be configured to control or regulate the speed of an elevator. The speed of the elevator may be based on a motor current that may be calculated or computed without the use of a current sensor. For example, the motor current may be determined based on one or more of a speed regulator output, a motor torque value, an encoder speed, a bus voltage, and a summation of motor current references. In some embodiments, a drive or converter input current or a motor voltage may be used to determine or regulate motor current and/or elevator speed.

Aspects of the disclosure have been described in terms of illustrative embodiments thereof. Numerous other embodiments, modifications and variations within the scope and spirit of the appended claims will occur to persons of ordinary skill in the art from a review of this disclosure. For example, one of ordinary skill in the art will appreciate that the steps described in conjunction with the illustrative figures may be performed in other than the recited order, and that one or more steps illustrated may be optional.

What is claimed is:

1. A method comprising:

calculating a current associated with a motor of an elevator based on an output of a speed regulator; and controlling the elevator based on the current;

comparing the current to a limit associated with at least one of a drive and the motor, wherein controlling the elevator comprises finishing an elevator run when the comparison indicates that the current is less than the limit, and wherein controlling the elevator comprises at least one of (i) halting the elevator, (ii) slowly bringing the elevator to a stop and running the elevator back to an initial position, and (iii) reducing a speed reference and having the elevator proceed to an initial landing, when the comparison indicates that the current is greater than the limit.

2. The method of claim 1, further comprising:

calculating a motor power associated with the motor; and measuring a bus voltage, wherein the current is calculated based on the motor power and the bus voltage.

3. The method of claim 2, wherein the motor power is based on a motor torque constant, associated with the motor and an encoder speed calculation, and wherein the current is calculated based on a power factor parameter and an efficiency parameter associated with the motor.

4. The method of claim 1, further comprising:

calculating the current based on current references associated with the motor.

5. A system comprising:

a speed regulator configured to receive a speed feedback and a speed reference and generate a torque current reference;

a controller configured to control an elevator's operation based on the torque current reference;

wherein the controller is configured to compare the torque current reference to a limit associated with at least one of a drive and the motor, wherein the controller is configured to perform:

controlling the elevator comprises finishing an elevator run when the comparison indicates that the torque current reference is less than the limit, and controlling the elevator comprises at least one of (i) halting the elevator, (ii) slowly bringing the elevator to a stop and running the elevator back to an initial position, and (iii) reducing a speed reference and having the elevator proceed to an initial landing, when the comparison indicates that the current is greater than the limit.

6. The system of claim 5, wherein the controller is configured to control the elevator's operation based on a comparison of the torque current reference to two different thresholds, wherein a first of the thresholds is associated with holding a car of the elevator, and wherein a second of the thresholds is associated with an acceleration of the car.

7. The system of claim 5, wherein the controller is configured to control the elevator's operation based on a calculated motor power associated with a motor of the elevator and a measured bus voltage.

8. The system of claim 7, wherein the measured bus voltage is associated with a battery voltage in a battery-based drive.

9. The system of claim 7, wherein the calculated motor power is based on a motor torque constant associated with the motor and an encoder speed calculation, and wherein the controller is configured to calculate a current associated with the motor based on the calculated motor power and a power factor parameter and an efficiency parameter associated with the motor.

10. The system of claim 5, wherein the controller is configured to control the elevator's operation based on a summation of a maximum torque per ampere current and a motor voltage regulator output current.

* * * * *